United States Patent [19]

Ellson

[11] 4,057,798

[45] Nov. 8, 1977

[54] SECURITY SYSTEM

[76] Inventor: George Andrew Ellson, 6715 SW. Cherry Hill, Beaverton, Oreg. 97005

[21] Appl. No.: 663,464

[22] Filed: Mar. 3, 1976

[51] Int. Cl.[2] ..... G08B 29/00

[52] U.S. Cl. ..... 340/420; 340/411

[58] Field of Search ..... 340/420, 411

[56] References Cited

U.S. PATENT DOCUMENTS

| | | | |
|---|---|---|---|
| 3,390,234 | 6/1968 | Glidden | 340/420 |
| 3,603,973 | 9/1971 | Hough | 340/420 |
| 3,978,479 | 8/1976 | Schmitz | 340/420 |

*Primary Examiner*—Thomas B. Habecker
*Attorney, Agent, or Firm*—Kenneth M. Durk

[57] ABSTRACT

A system for automatic detection of the presence of intrusion by an intruder and/or the phenomenon of combustion manifested in light, flame, and heat, and having delay before activating alarm means for preventing non-genuine detection is provided using digital, solid-state circuitry modules thereby facilitating installation, maintenance, and expansion of the system. An electronic combination lock coupled to the system controls the system to enable the detection of intrusion to be amended by the proprietor of an enclosure protected by the system. Separate alarm means having unique alarm sounds for intrusion and the phenomenon as well as optional telephone dialing of appropriate responding agencies is provided.

14 Claims, 5 Drawing Figures

SECURITY SYSTEM

BACKGROUND OF INVENTION

Many security systems have been employed in the past to combat burglary and theft as well as fire. These systems have generally been unsatisfactory due to a high rate of false alarms and ease of defeat by intruders with knowledge of the systems weakness. For example, prior art systems utilizing key-operated locks to permit authorized personnel to enter and leave the protected premises are easily picked. Other prior art systems include capacitive, sonic, ultrasonic, and photo-electric sensing techniques; such systems, however, are sensitive to environmental conditions and are not completely reliable over a wide range of conditions of temperature and humidity, or they are subject to electrostatic and mechanical disturbances. Further, these systems make no provision for having a tenant, prior to activation of the system, automatically initiate a test of the system without notifying the appropriate responding agencies of the test.

Yet another disadvantage of security alarm systems of the prior art is the problem of ingress by individuals, say former employees, having previous access to areas surveyed by the system. One such system utilizes plastic laminated cards, issued during employment, having coded information in the form of, for instance, suitably positioned electric conducting elements of magnetic ink indicia. In this arrangement reading means is employed to "read" the information positioned on the card and if the intelligence imparted therefrom meets certain predetermined criteria, access to the surveyed area is obtained. However, such systems are expensive as is well known.

SUMMARY OF INVENTION

The general purpose of the present invention is to provide a security system for protecting residential or commercial premises which possesses none of the disadvantages of the afore described or other prior art against intrusion by an intruder and/or fire.

Accordingly, the present invention incorporates into a single master control unit the system electronics including a master control switch and a disable switch. All normal operation of the system is accomplished through control units conveniently located throughout the area protected in a closed loop activated by a break in the loop, and an open loop which is activated by a closure or short circuit of the loop. Two operating modes, "ON" where the system is triggered by a security violation and "OFF" where any attempt to tamper with the system will trigger the system. Also provided is an automatic security check and automatic battery test when arming the system, automatic transfer to standby power and audible alert if the main power fails, false alarm preventing, pre-alarm warning, and an automatic reset after the alert has sounded for several minutes.

It is therefore an object of the present invention to provide a security system which cannot be circumvented or defeated.

It is an additional object of the present invention to provide a security system having simplicity of operation.

It is yet an additional object of the present invention to provide a means for a system requiring a multiplicity of activations.

It is another object of the present invention to provide a security system using digital solid-state circuit modules for facilitating installation, maintenance, and expansion of the system.

It is yet another object of the present invention to provide a security system incorporating a tamper proof lock.

It is yet still another object of the present invention to provide a security system incorporating a combination lock.

It is a further object of the subject invention to provide a security system incorporating false alarm prevention.

It is a yet further object of the system invention to provide a security system incorporating automatic battery test circuit.

It is a still further object of the subject invention to provide a new combination lock.

The foregoing and numerous other objects, advantages, and inherent functions of the present invention will become apparent as the same is more fully understood from the following description, which describes the invention; it is to be understood, however, that the described embodiments are not intended to be exhausting nor limiting of the invention but are given for purposes of illustration in order that others skilled in the art may fully understand the invention and principles thereof and the manner of applying it in practical use so that they may modify it in various forms, each as may best be suited to the conditions of the particular use.

DESCRIPTION OF INVENTION

DESCRIPTION OF INVENTION

Figure 1:
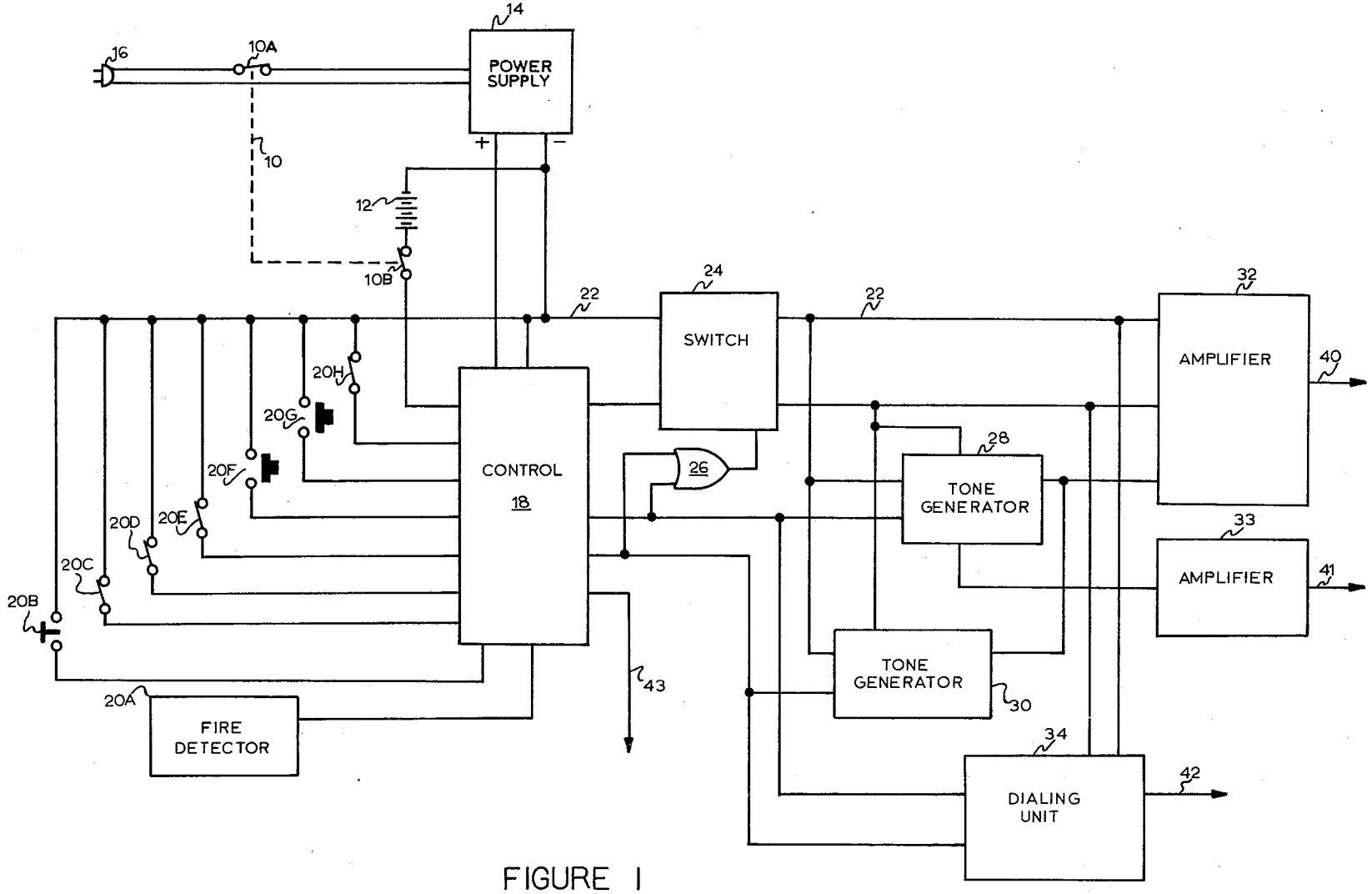
FIG. 1 is a simplified block diagram of the security system according to the present invention.

Referring to the drawing, and FIG. 1 in particular, the security system of the present invention in its simplest form is seen to comprise a power switch 10, including ganged sections **10*a* and 10*b* which may suitably comprise a toggle or key operated switch which selectively or automatically connects the remainder of the system to either a battery source 12 or power supply 14 for energizing the system. In a closed position of switch 10, ON as shown, the system operates from a 115 to 125 volt source of alternating current via the AC line adapter 16 to feed power supply 14 or in case of a line power failure the system operates from battery source 12. In the preferred embodiment power supply 14 and battery source 12 are commercially available API Model 185** or equivalent and Everready No. 1463 or Neda 922, respectively. It should be noted that in the above and following description, all of the various circuits are of conventional construction commonly known to persons skilled in the art and that there are many equivalent forms and modifications thereof all of which may be used to practice the principles of the invention. For instance, it is a simple conversion to operate the system from a higher source of alternating current, say 220 volts.

Control module 18, responsive to the closure of switch 10, contains the systems logic which will be fully explained elsewhere in the description and is operative from a plurality of control units 20A–20H. Control units 20A–20H are, for example, various proximity type switches placed to be activated by intrusion in the area secured or smoke detectors to detect fire or operation switches to enable or disable the system, each connected in series between the control module and an electrical common, say ground bus 22. These control units may be loop connected open or closed, but the preferred embodiment normally utilizes both open and closed loops. Responsive to the control module is a switch 24 connected to be activated by the detection of either intrusion or fire via the logic means 26 for activating an appropriate intrusion or fire tone generator 28 and 30 respectively, for generating a tone which is amplified by an amplifier 32 or 33 for driving conventional speakers (not shown) connected to lines 40 and 41 to indicate same or to activate, say a telephone dialing unit 34 for automatically notifying, via telephone lines indicated by the line 42, appropriate responding agencies. Control module 18 also includes an intrusion pre-warning output along the line 43, which, will be described elsewhere in the description.

Before proceeding, it is pointed out that the following description deals with binary logic, which deals with variables that take on two discrete values with operations that assume logic meaning. The two values the variables take may be called by different names, but for the following description it will be convenient to think in terms of bits and assign the values of 1 and 0 or high and low, respectively. Additionally, the circuits encountered either performs a specific information process operation fully specified logically by a set of Boolean functions utilizing logic gates whose outputs at any time are determined directly from the present combination of inputs without regard for previous inputs or sequential circuits employing memory elements in addition to logic gates where the outputs are a function of the inputs and the state of the memory elements; the state of memory elements is, in turn, a function of previous inputs. For instance, a bistable circuit or flip-flop, as it is commonly called, may have J, K inputs, a SET input, RESET input (clear), CLOCK input, and Q or 1 and $\overline{Q}$ or 0 output. This flip-flop is edge sensitive to the clock input and can change state on the positive going transition of the clock pulses. Set or reset is independent of the clock and is accomplished by a high level on the respective input. It will further be assumed that a logical one is represented by a relative positive voltage.

It should also be pointed out at this time that the plurality of integrated circuits used to form the system are all commercially available and well known to those skilled in the art. As such, it is believed appropriate that they be mentioned at this time to avoid being repetitious in the remaining description. They are listed in Table 1 along with their functions. Additional information concerning the operation and characteristics thereof can be obtained by referring to the manufacturers' reference literature therefore.

| FUNCTION | DESCRIPTION |
|---|---|
| Flip-Flop | RCA CD4027: Dual J-K master slave |
| AND Gate | RCA CD4081: Quad, 2 input |

-continued

| FUNCTION | DESCRIPTION |
|---|---|
| OR Gate | RCA CD4071; Quad, 2 input |
| Counter/Divider | RCA CD4024: 7 stage binary |
| Counter/Divider | RCA CD4020: 14 stage binary ripple |
| Inverter | RCA CD4009: Hex inverting buffer/converter |
| Timer | National LM555: Timer |
| PROM | Signetics 8223: 256 Bit-bipolar, field programmable |
| RAM | TI SN 7489; 64 Bit Read/Write memory |
| Voltage Regulator | National LM 340-5: 3 terminal sense |
| Buffer | RCA CD4010: Hex non-inverting buffer/converter |
| NAND Gate | RCA CD4011: Quad, 2 input |

Figure 2:
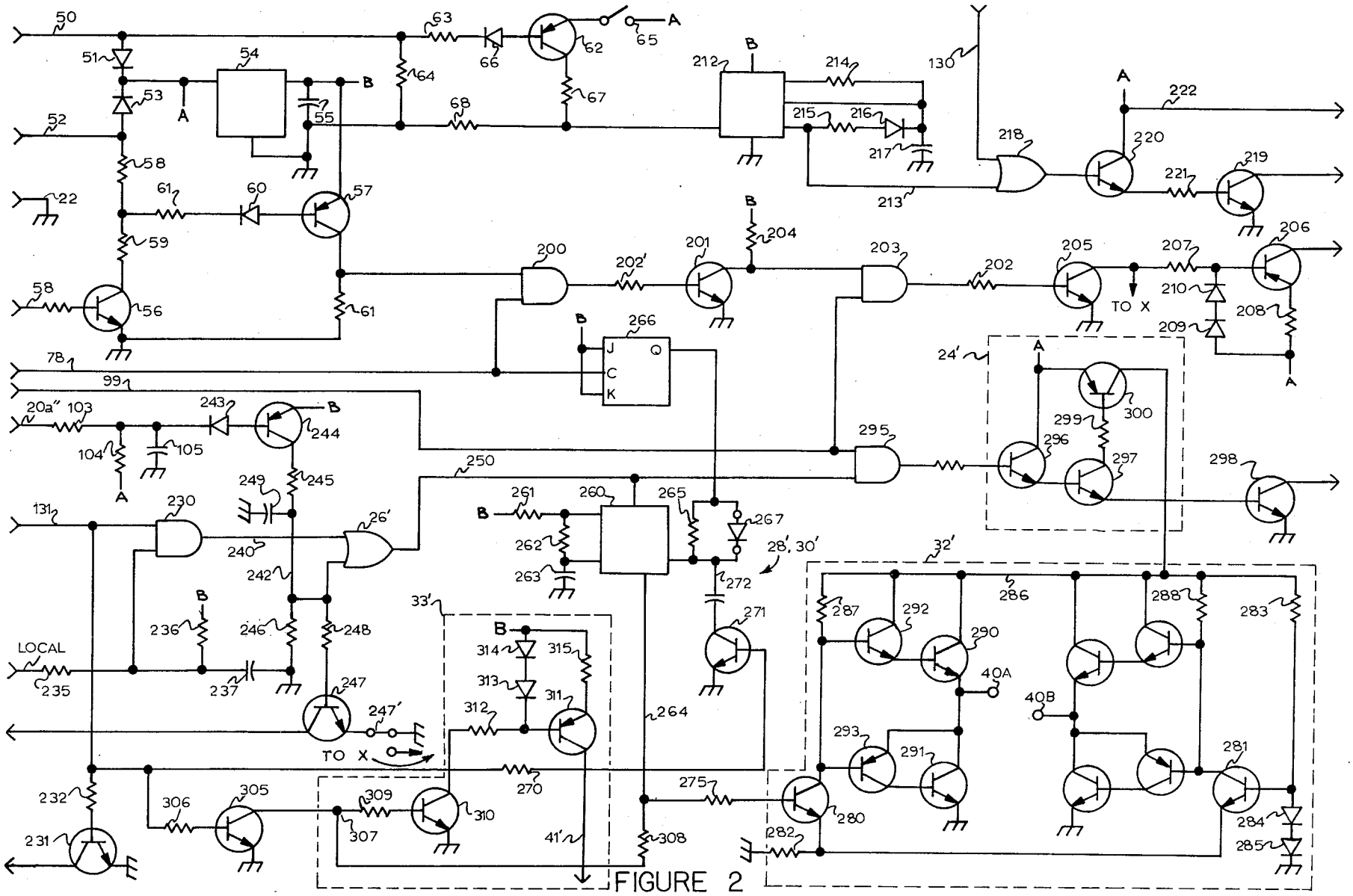
FIG. 2 is a diagram of a portion of circuits of the security system of the present invention.
Figure 3:
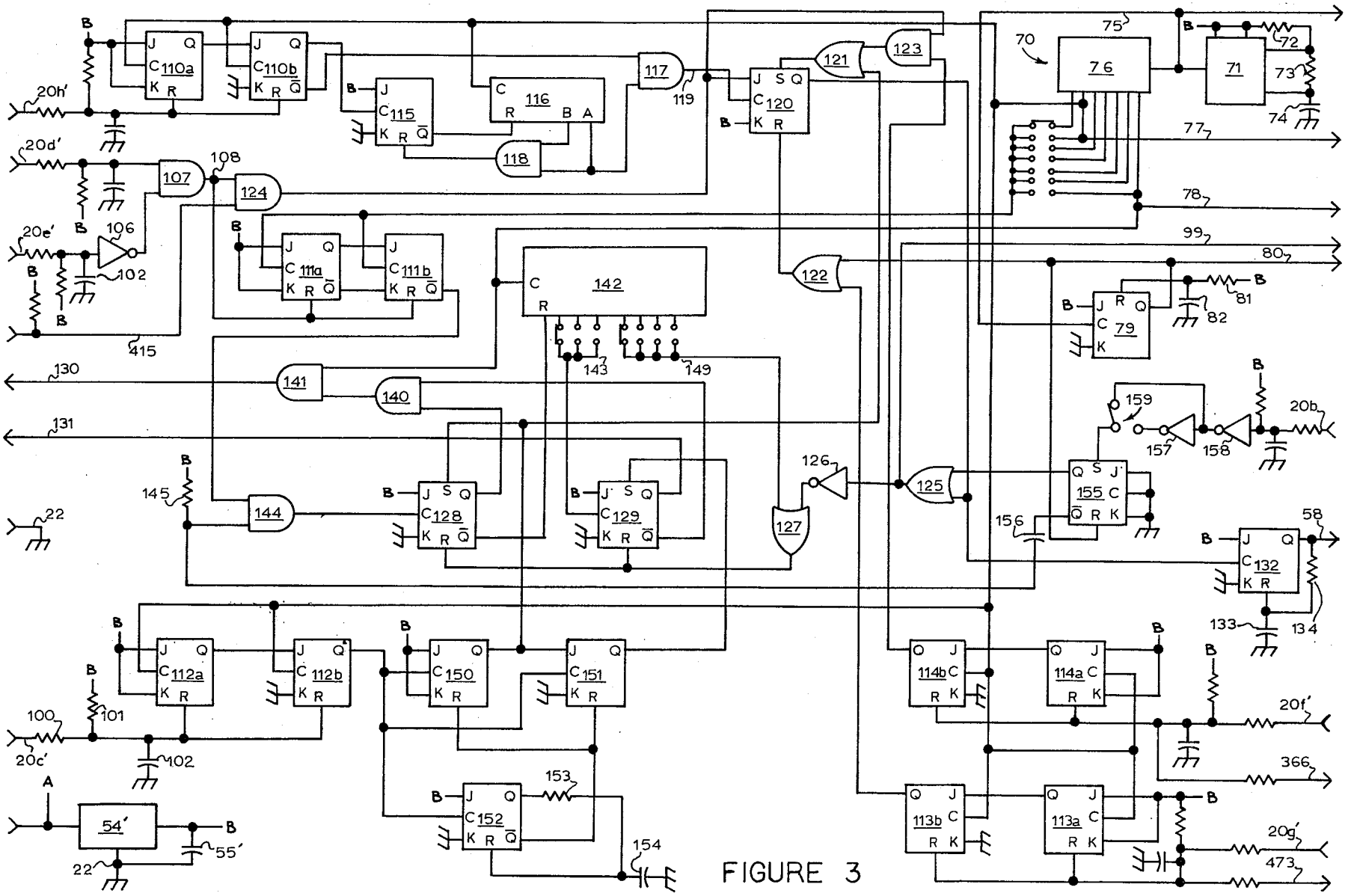
FIG. 3 is a diagram of a further portion of circuits of the security system of the present invention.

Referring now to FIGS. 2 and 3, there is shown the schematic diagrams for the actual circuits shown in FIG. 1. In the preferred embodiments of the invention, each diagram represents the circuit disposed on a printed circuit board and connections between such boards are given individual reference numerals and arrows represent signal flow direction.

Power, preferrably in the form of 12 volts direct current from supply 14 (+ lead) is applied to the system via line 50 (of FIG. 2) and through the diode 51 to a common source of system potential A, say of 12 volts less the diode voltage drop of diode 51 or alternatively in the event of a line power failure and/or supply 14 failure from the battery 12 via the line 52 and diode 53. These diodes, which are preferrably IN4719, have their cathodes connected together to form an OR gate. It is to be noted that battery 12 is slightly less potential than supply 14 to maintain diode 53 non-conducting if supply 14 is operating properly. Voltage regulator 54, responsive to the A source potential, provides a second source of system potential B, say of 5 volts which is decoupled to ground via 10 microfarad capacitor 55. A battery test circuit comprising a 2N3904 transistor 56 and a 2N3906 transistor 57 is activated each time operating power is applied to the system to provide an indication of the status of standby power as described hereinafter. A high on line 58, to be explained elsewhere, is applied via a 4.7 k-ohm base resistor for transistor 56 to switch such transistor on. Battery potential on line 52 produces current through a load comprising serially connected resistors 58 and 59 of 110 and 63 ohms, respectively to produce a voltage at the junction thereof. This voltage, dependent upon the battery potential, is compared against the B source via the emitter base junction of transistor 57, 1N3600 diode 60 and 10 k-ohm resistor 61. If the B source is two diode drop volts higher than such junction voltage, transistor 57 is biased conductive to produce a collector voltage thereof across a 4.7 k-ohm resistor 61. Such voltage is utilized to indicate the failure. In the preferred embodiment, battery potential of about 10 volts or less causes transistor 57 to conduct indicating a low battery condition. A second circuit comprising 2N3906 transistor 62 is provided to indicate a loss of line power or power supply failure by comparing the supply voltage on line 50 at the junction of 4.7 k-ohm resistors 63 and 64 to the A source via switch 65, the emitterbase junction of transistor 62 and diode 66 which is preferrably 1N3600. In this instance, if the supply voltage is two diode drop volts lower than the A source and if switch 65 is closed, transistor 62 is biased conductive to produce a voltage between serially connected 6.2 k- and 4.7 k-ohm resistors 67 and 68 respectively, connected as a load for transistor 62. Such voltage at the junction is utilized to indicate the failure.

Switch 65 is provided to defeat such circuit if desired by disabling the transistor 62 at all times. In the preferred embodiment, the indication of a low battery condition is provided via visual indicators whereas the indication of a power failure is provided via audio indicators. These visual and audio indicators will be described elsewhere in this description.

It is seen in FIG. 3 that a means generally indicated as 70 is provided for generating a plurality of timing pulses and includes a timer 71 properly connected between another regulated B source from regulator 54' and line 22. As regulator 54' is identical to regulator 54 no further discussion will be presented. Timer 71 has disposed thereabout 150 k-ohm resistors 72 and 73, and a 0.01 microfarad capacitor 74 to properly operate same in a conventional manner and provides an output therefrom consisting of a train of continuous pulses of preferably 4 ms duration on the line 75. These 4 ms duration pulses are coupled also to a 7 stage binary counter/divider 76, which in turn, provides a further plurality of continuous pulse trains dividing down from the 4 ms pulses. These plurality of pulses are of 8, 16, 32, 64, 128, 256, and 512 ms duration, respectively. Each of these plurality of pulses are coupled to a selector means for selective use throughout the system. Additionally, the 16 and 512 ms duration pulses are available on the lines 77 and 78. As can be discerned, means 70 provides the necessary timing or clock signals to operate the system.

A power up, clear system initator comprising a high J and low K connected J-K flip-flop 79 is coupled to timer 71 to clock the Q output high on the first 4 ms pulse and provides the high on line 80, the purpose of which will become apparent shortly. A series connected 500 k-ohm resistor 81 and 1 microfarad capacitor 82 are connected between the B source and ground (line 22) and being coupled to the reset input of flip-flop 79 allows the flip-flop to set Q high and then resets the flip-flop (Q-low) by charging capacitor 82 to a necessary level after a period of time. This power up, clear system initator operates only once each time power is applied to the system.

As previously discussed, the logic is responsive and/or operative from a plurality of control or detector devices 20A–20H (shown on FIG. 1) being activated. These devices are coupled to the logic shown mostly in FIG. 3 via the lines **20*b'–h'*. Such logic will now be considered and it can be seen that each of the lines 20*b'–h'* are coupled via 1 k-ohm resistors 100 to the junction of serially connected 20 k-ohm resistors 101 and 0.01 microfarad capacitors 102 connected between the B source and ground whereas line 20*a'* is coupled via a 47 k-ohm resistor 103 (see FIG. 2) to the junction of serially connected 510 k-ohm resistor 104 and 0.02 microfarad capacitor 105 connected between the A source and ground. These resistor and capacitor networks are utilized to filter and bypass noise spikes associated with operation of the control units 20A–20H for reasons well known. For practical reasons, numbers have been only shown for the networks connected to lines 20*a'* and 20*c'*. With the exception of the network connected to lines 20*e'*, normal conditions are such that the referred to junctions are at a high voltage level. The low voltage level on line 20*e'* is inverted via inverter 106 and anded together with the high voltage level on line 20*d'* by AND gate 107 to provide a high at the junction 108. This arrangement is necessary in that line 20*e'* in the preferred embodiment is a normally closed detector. As can now be discerned, under normal operating conditions, a high voltage level is applied to the clear inputs of a plurality of dual J-K flip-flops 110A-B, 111A-B, 112A-B, 113A-B, and 114A-B which are used to sense a non-normal condition of corresponding control units. Each A flip-flop has its J and K inputs connected together and connected to the B source and its clock input coupled to the line 77 (16 ms pulses) except for flip-flop 111A which has its clock input coupled to selectively receive any one of the plurality of pulses supplied via counter/divider 76 as already discussed. The purpose of having a selectable clock is to provide alarm verification to be discussed elsewhere. The B flip-flop is also clocked from the line 77 and has its J input connected to the Q output of the A flip-flop and its K input grounded (an exception: flip-flop 111B has its K input coupled to the $\overline{Q}$ output of flip-flop 111A** and its also coupled to receive one of the selectable clock pulses). It should be noted that unused inputs of these J-K flip-flops and other logic devices utilized are grounded and that each is properly connected to a source of power not shown in the diagrams.

Flip-flop 110, flip-flop 115, 7 stage counter/divider 116 and AND gates 117 and 118 form a system pick-proof lock, an object of the present invention. Flip-flop 115 is clocked from the Q output of flip-flop 110B and has its J and K inputs connected to the B source and ground, respectively. The $\overline{Q}$ output thereof clears counter/divider 116 which is clocked by the 16 ms clock pulses via the line 77. Flip-flop 115 is cleared by anding selected outputs of the counter/divider 116 via AND gate 118. The output of the pick-proof lock is the signal on line 119 obtained from anding together one of the selected outputs of counter divider 116 and the $\overline{Q}$ output of flip-flop 110B. Operation of the above connected circuit is as follows. Under normal condition line **20*h'* is high, flip-flop 110 is cleared and line 119 is low. Assume, that control unit 20H is a normally open key operated switch to enable or disable the system. Upon closure of the switch, a low will be present on line 20*h'* which places a low on the reset inputs of flip-flop 110. If line 20*h'* remains low for at least two clock pulses, flip-flop 110B will latch the high Q state of flip-flop 110A and clock flip-flop 115 to the Q high state. As counter/divider 116 has its clear input coupled to the $\overline{Q}$ output of flip-flop 115, it is allowed to count the 16 ms input pulses. Counter/divider 116 counts the 16 ms input pulses and eventually an A output thereof goes high. If the switch is again opened, allowing line 20*h'* to go high, AND gate 117 will be enabled to provide a high on the line 119. Four clock pulses afer counter/divider 116 A output goes high, its B output goes high to enable AND gate 118. AND gate 118, in turn, provides a high on the reset input of flip-flop 115 to clear counter/divider 116. If the switch is not opened before the A and B outputs of counter/divider 116 becomes high, AND gate 119 will not be enabled and the line 119 remains low. As can be discerned, the circuit places a time limit for a complete close/open cycle on the line 20*h'* if an output is to be obtained on the line 119. In the preferred embodiment, this time limit is about 1 second. As stated, under certain conditions, a high will be provided on the line 119. This high is utilized by a system status flip-flop to be discussed shortly and without such high on line 119** the desired operation will be inhibited. The operation of the circuit also seeks to eliminate false alarms, another object of the present invention, caused by intermittent operation of the sensor by requiring the alarm condition to exist for a selectable period of time before triggering the alarm. It should also be noted that the clock pulses are chosen to have a period greater than the debounce period of the control unit for obvious reasons.

A system status flip-flop 120 is next provided and is set via OR gate 121 or reset via OR gate 122. One input of the OR gate 121 is obtained from the output of AND gate 123 which ands together the Q output of an enable flip-flop 114 and the output of another AND gate 124; the other input is obtained from a panic circuit to be described elsewhere in the description. One input of OR gate 122 is obtained from the signal on line 80 which has been discussed previously and the other from the Q output of a disable flip-flop 113. Flip-flop 120 has its J input also coupled to the output of AND gate 124, its K input connected to the B source and its clock input to the line 119. Status flip-flop 120 has the function of arming the system i.e., set all circuits to be actuated by an intrusion or disarming the system. The Q output is coupled to clear inputs of a pre-alarm flip-flop 128 and an alarm flip-flop 129 via an OR gate 125, inverter 126 and another OR gate 127. (Note: The output of OR gate 125 is also coupled to other circuits via the line 99.) Additionally, the Q output of the status flip-flop is coupled as the clock input to a self-clearing flip-flop 132. Flip-flop 132 whose J input is connected to the B source and whose K input is grounded sets on the initial Q high state of flip-flop 120 to provide a high on line 58 until such time as 10 microfarad capacitor 133 is charged via 510 k-ohm resistor 134 to clear the flip-flop. The high on line 58 is utilized to initiate the battery test circuit already discussed.

As previously mentioned, flip-flops 128 and 129 are utilized to provide a pre-alarm and an alarm signal. Each flip-flop has its J input connected to the B source and its K input grounded. The Q output of flip-flop 128 and the $\overline{Q}$ output of flip-flop 129 and anded together via AND gate 140 whose output is subsequently anded together via AND gate 141 with the 512 ms clock pulses via line 78 to provide the pre-alarm signal on line 130 whereas the Q output of flip-flop 129 provides the alarm signal on line 131. Flip-flop 128 has its $\overline{Q}$ output coupled to the clear input of a 14 stage counter/divider 142 which, in turn, is coupled to be clocked by the 512 ms pulses to provide a plurality of timing pulses to clock flip-flop 129. In the preferred embodiment, these timing pulses are of 15, 30 and 60 second duration and are selectively applied to flip-flop 129 via a selector means 143 which could be jumper wires, switch, etc. Counter/divider 142 also provides a further plurality of timing pulses of preferrably 2, 4, 8, and 16 minutes duration and are selectively applied via another selector means 149 to the clear input of the flip-flops 128 and 129 via the second input to the already mentioned OR gate 127. The clock input to flip-flop 128 is obtained from the output of an AND gate 144 having one input coupled to the $\overline{Q}$ output of flip-flop 111B and the other input connected to the B source via a 20 k-ohm resistor 145.

Pre-alarm and alarm flip-flops 128 and 129 are coupled to be set from the Q outputs of additional flip-flops 150 and 151 respectively, the former also connected as one input to the already mentioned OR gate 121. Flip-flop 150 has both its J and K inputs coupled to the B source and is clocked from the Q output of the already mentioned flip-flop 112B. Flip-flop 151 is also coupled to be clocked from the Q output of flip-flop 112B but has its J input coupled to the Q output of flip-flop 150 and its K input grounded. Both flip-flops 150 and 151 are connected to be cleared via the $\overline{Q}$ output of another flip-flop 152 whose clock input is also coupled responsive to the Q output at flip-flop 112B. Flip-flop 152 is self-clearing via the serially connected 100 k-ohm resistor 153 and 10 microfarad capacitor 154 connected between the Q output and grounded and coupled to the clear input thereof.

Another flip-flop 155 having its J, K and clock inputs all grounded is also coupled to the pre-alarm and alarm flip-flops by having its Q output connected as an input to the already mentioned OR gate 125 and its $\overline{Q}$ output coupled via a 0.1 microfarad capacitor 156 to the already mentioned resistor 145 and AND gate 144. Flip-flop 155 is cleared from the line 180 and set via inverters 157 and 158. The inverter 157 may be selectively connected to be bypassed via the selector means 159, if desired, and is provided so that either a normally open or normally closed control unit 20B (see FIG. 1) can be utilized to activate flip-flop 155 via the line **20*b*'.**

Having detailed the above circuits, the operation thereof will now be considered. First, for the moment, assume that power has been applied and the battery and line test sequence have been performed. As soon as the signal on line 80 goes low due to flip-flop 79 being reset, status flip-flop 120 is released from its clear status. If a low signal is available on the line **20*f*' from an enable control unit 20F and the J input to status flip-flop 120 is high or proper actuation of the key switch has taken place or the Q output of the flip-flop 150 is high, status flip-flop 120 sets to its Q high state which is applied as a low to the reset of flip-flops 128 and 129 via the gates 125, 126, and 127. This allows the flip-flops 128 and 130 to be set on positive transitions of their respective clock pulses. Additionally, the line 99 goes high to provide a systemed armed signal for the various other circuits to be considered later in this description. Conversely, if a low signal is available on line 20*g*' via a disable control unit 20G, or if status flip-flop 120 has a Q high output and line 119 goes high, the system becomes disabled by clearing the pre-alarm and alarm flip-flops as well as having line 99** low.

Assume, for example, that status flip-flop 120 is in the Q high state to arm the system. The presence of an intrusion, say, a low on line **20*d*' or a high on the line 20*e*' causes the reset of flip-flop 111A and 111B to go low allowing flip-flop 111B to toggle on the selected clock pulse to the Q high, then Q low. When the $\overline{Q}$ output of flip-flop 111B goes high, the output of AND gate 144 goes high thereby setting pre-alarm flip-flop 128 to its Q high state. Flip-flop 128 being set removes the clear from counter/divider 142 and causes a signal on line 130 to alternate high and low at a 512 ms rate via gates 140 and 141. When counter/divider 142 has its output high via selector 143, flip-flop 129 sets to its Q high state which disables the alternating pre-alarm signal via gate 140 not having coincidence and provides a high alarm signal on the line 131.**

When counter/divider 142 has a high output via selector 149, the pre-alarm and alarm flip-flops are reset via OR gate 127 to terminate the cycle. If the intrusion still exists, flip-flop 111B will be toggling and flip-flop 128 will be again set on the next positive transition to start the cycle again.

Flip-flops 112, 150, 151, and 152 are provided to enable an alarm condition without an actual intrusion, which is usually referred to as panic condition. The present invention provides a panic circuit which almost entirely eliminates false alarms, a vast improvement over prior art panic circuits in that a multiplicity of activations must be performed within a limited period of time. Control unit 20C, being activated once either intentionally or otherwise produces a low on the 20c' line which is applied to release flip-flop 112. If line 20c' is low long enough, flip-flop 112 goes Q high to toggle flip-flop 152 Q high. (Initially flip-flops 150, and 151 were Q low due to a $\overline{Q}$ high on flip-flop 152.) If the panic circuit is not activated before flip-flop 152 clears itself via the charging of capacitor 154, the circuit reverts back to its initial condition. However, if the panic is again activated, flip-flop 112 Q output goes high again and will toggle flip-flop 150 to the Q high state whereas flip-flop 152 will remain Q high. Flip-flop 150 going Q high sets pre-alarm flip-flop 128 and insures that status flip-flop 120 is enabled as previously discussed via OR gate 121. As usual, line 130 is alternately high and low indicating a pre-alarm condition. If the panic circuit is again activated before flip-flop 150 is cleared, flip-flop 112 Q output sets flip-flop 151 to set alarm flip-flop 129 and activate the alarm line 131. It should be noted that the panic circuit just described could easily be adapted, say, to be utilized in many environments other than the security system. For example, many industrial machines could utilize the circuit to prevent nonintentional operation thereof.

Yet another means to activate the system is via the control unit 20B setting the flip-flop 155. A low on the line 20b' is inverted to set the flip-flop 155 Q high to release the pre-alarm and alarm flip-flops whereas the $\overline{Q}$ output of the flip-flop is applied via capacitor 156 to clock pre-alarm flip-flop 128 and the alarm flip-flop 129 as previously explained. A high on the line 20b' could also be utilized if amplifier 157 were connected.

Having now described the logic of the system, reference should be made again to FIG. 2 wherein are shown the circuits utilizing the various outputs obtained from the system logic shown in FIG. 3.

The first portion of the diagram to be considered is the circuits necessary for the indications of a low battery or line power failure. Status indicators such as lights (not shown) conveniently located will come on when the system is armed, go off when the system is disarmed and blink when the system is armed and a weak battery is detected as hereinafter described. When line 99 goes high (system armed), such high is anded together with another high provided from the B source via a 4.7 k-ohm resistor 204 via AND gate 203 to turn on a grounded emitter 2N3904 transistor 205 via a 10 k-ohm base resistor 202. Transistor 205 having its collector coupled to the base of TIP 30 power transistor 206 via a 470 ohm resistor causes such transistor to turn on. As the indicator lights would be conventionally connected to the collector of the transistor 206, such lights would be made to light. A pair of 1N3600 diodes 209 and 210 are serially connected between the A source and the base of transistor 206 as well as a 1.2 ohm resistor 208 disposed between the A source and emitter of transistor 206 provide current limiting of the indicator lights to prevent a shorted light from shutting down the system. For example, when the voltage drop across resistor 208 equals the voltage drop across one diode, the base current of transistor 206 is shunted through diodes 209 and 210 to limit the drive for transistor 206. If a weak battery is detected (a high voltage across the resistor 61), the indication is anded together with the 512 ms clock pulse via line 78 and the AND gate 200 to provide a high to alternately turn a 2N3904 grounded emitter transistor 201 on and off at the 512 ms clock rate via another 10 k-ohm base resistor 202'. Transistor 201, turning on and off thereby causes AND gate 203 to be alternately enabled at the same rate because the collector thereof is coupled to the resistor 204. As such the indicator lights are caused to alternate or blink.

A timer 212 coupled to be activated by the voltage developed across the resistor 68 (voltage developed if power fails) is operated between the B source and ground and produces on the line 213 a train of pulses having a duration of about 250 ms at a high level and 4 second at a low level as set by 510K and 33 k-ohm resistors 214 and 215, a 1N3690 diode 216 and a 10 microfarad capacitor 217 disposed thereabout in a conventional manner. These output pulses are applied to an OR gate 218 along with the already discussed pre-alarm signal on line 130 to operate a pre-alarm circuit. The pre-alarm circuit comprises a grounded emitter transistor 219 which is preferably a 2N5964 whose base is connected to the emitter of a 2N3904 transistor 220 via a 470 ohm resistor 221. The collector of transistor 220 is connected to the A source and is also supplied on the output line 222 whereas the collector current of transistor 219 is available to drive, say, a Sonalert to provide an audible indication that a pre-alarm exists or that a line power or power supply failure has occurred; the sound being dependent upon whether the signal via the line 213 or 130 activates the base of transistor 220 via the OR gate 218. (The collector of transistor 219 and the line 222 are represented in FIG. 1 by the numeral 43.)

The alarm signal, if developed, is applied on the line 131 to an AND gate 230 and to a 2N3904 switching transistor 231 via a 10 k-ohm base resistor 232 whose emitter is grounded and whose collector drives a commercially available telephone dialing unit (34 of FIG. 1). Such a dialer should be provided with a means which provides an output hereinafter referred to in common terms as a local alarm well known to those in the art. This signal is applied on the line labeled LOCAL and is filtered via a 1 k-ohm resistor 235 connected to the junction of a serially connected 20 k-ohm resistor 236 and a 0.01 microfarad capacitor 237 which are connected between the B source and ground. The filtered LOCAL signal is also applied to an input of AND gate 230 where coincidence between the system alarm and LOCAL will provide a high on the line 240.

Line 240 is coupled to OR gate 26' (26 of FIG. 1) as is line 242. Line 242 carries a signal obtained by the detection of a fire via control unit 20A, which, for the preferred embodiment is of the commercially available ionization type for providing a normal high on line 20a' and a low thereon upon detection of fire. Such a low is debounced via the already discussed debounce network and allows normally reversed 1N3600 diode 243 to connect current to turn on a 2N3906 transistor 244 whose emitter is coupled to the B source and where collector is coupled to ground via series connected collector load resistors 245 and 246 of 1K and 10 k-ohm respectively. Upon detection of fire, a voltage is developed across the resistor 246 for application to OR gate 26' via line 242 connected thereto. This line also connects the base of a normally grounded emitter switching transistor 247 via a 10 k-ohm resistor 248. The collector of such transistor is also connected to the commercially available telephone dialing unit to provide the necessary drive. Capacitor 249 may be connected between the line 242 and ground to filter the switching transient of the switching transistor 244 if desired. In the preferred embodiment, capacitor 249 has a value of 1 microfarad. It should be noted that it is also within the scope of the invention to provide a switch means 247' in the emitter of transistor 247 which normally connects the emitter thereof to ground to trigger the dialer anytime a fire is detected or connected to the collector of transistor 205 to trigger the dialer only when a fire is detected and the system is armed.

With the detection of either fire or intrusion, OR gate 26' provides a high on the line 250. Such line is coupled to initiate the fire and intrusion tone generators 28 and 30, which in the preferred embodiment is a single tone generator having means to sweep between two tones to differentiate between either a fire or intrusion. Such a circuit is generally indicated by the arrow 28,30 and is hereinafter described. Line 250 going high, due to detection, initiates a timer 260 having series connected 5.1K, 4.7 k-ohm resistors 261, 262 and 0.1 microfarad capacitor 263 connected between the B source and ground disposed about such timer to provide an output signal thereof on the line 264. An additional 10 k-ohm resistor 265 is also coupled to timer 260 and to the Q output of a J-K flip-flop 266 whose J and K inputs are coupled together and connected to the B source enabling such flip-flop to be toggled at a 512 ms rate via the line 78. A diode 267 may be disposed across the resistor 265 to, say, modify the tones generated for systems in close proximity to each other. In operation, the output of the tone generator therefore switches between the normal output and that modified by the flip-flop 266 for a tone representing the detection of fire. If an intrusion is detected, the high on line 131 is coupled via a 10 k-ohm resistor 270 to the base of a grounded emitter switching transistor 271, which, saturates to effectively ground one terminal of a 10 microfarad capacitor 272 having its other terminal connected to resistor 265 and timer 260. The addition of the capacitor 272 produces a voltage which modulates the output signal on line 264 to sweep the tone of the tone generator between the normal output and that modified by flip-flop 266 to indicate intrusion.

Line 264 is connected via a 1 k-ohm resistor 275 to the output amplifier 32 for amplifying the signals via the tone generator to operate, say siren speakers connected to the line 40 of FIG. 1 (40A and 40B of the subject FIG. 2). Basically, the circuit is a conventional quasi-complementary amplifier and includes a pair of over driven 2N3904 transistors 280 and 281 whose emitters are coupled together and to ground via a 51 ohm common emitter resistor 282. The base of transistor 280 is connected to the resistor 275 for coupling the signal on line 264 whereas the base of transistor 281 is coupled to a suitable source of potential reference such as the junction between serially connected 1 k-ohm resistor 283 and a pair of 1N3600 diodes 284 and 285 all connected between a source of potential selectively applied on a common bus 286 and ground. The collectors of transistors 280 and 281 are connected via 1 k-ohm load resistors 287 and 288 to the bus 286. Each side of the amplifier includes a pair of 2N3055 transistors 290 and 291, a 2N3904 transistor 292 and a 2N3906 transistor 293 conventionally connected to provide drive for the siren speaker at the terminals 40A and 40B. As this circuit is well known, no further discussion is believed necessary.

As previously stated, the voltage potential on bus 286 is selectively applied to the amplifier and is done to conserve power when no detection has taken place. This is accomplished via the power switch 24' now described. The detection signal via line 250 is coupled to an AND gate 295 whose other input is coupled to the line 99 having thereon the system armed signal. The coincidence of such signals produces a high output thereof which is applied to the base of a 2N3904 transistor 296 whose collector is coupled to the A source and whose emitter is directly coupled to 2N5964 transistor 297. The emitter of transistor 297 is, in turn directly coupled to the base of a grounded emitter 2N3055 transistor 298. The collector of transistor 297 is applied via a 2 watt, 35 ohm resistor 299 to the base of a 2N2955 transistor 300 whose emitter connects to the A source and whose collector connects to the bus 286. The collector of transistor 298 is utilized to drive additional accessories not shown. In operation, the discussed coincidence of the signals on line 250 and 99 turns transistor 296 and 297 on, which causes transistor 300 to saturate to essentially switch the system A source to bus 286.

Also shown on the subject diagram is an additional circuit defining the amplifier 33 of FIG. 1 for driving additional speakers, say, connected to the output 41. This circuit is disabled during the detection of intrusion by supplying such a detected signal on line 131 to the base of 2N3904 grounded emitter switching transistor 305 via a 33 k-ohm base resistor 306 to effectively ground the input 307 to the amplifier which is coupled to receive the signal on line 264 from the tone generator via 4.7 k-ohm resistor 308. With no detection of intrusion but detection of fire, the tone signal is applied via a 4.7 k-ohm resistor 309 to alternately switch a grounded emitter 2N3904 transistor 310 on and off. Such transistor has its collector connected to the bae of a TIP 30 transistor 311 via a 220 ohm resistor 312. The base of transistor 311 is also connected to serially connected 1N3600 diodes 313 and 314, the latter of which is coupled to the B source. The emitter of transistor 311 is coupled via a 1.2 ohm resistor 315 to the B source whereas the collector is the output line 41' for driving the additional speakers. Such amplifier is provided when it is desired to provide speakers internal to the area secured to positively provide an audible indication of fire detection to, say, personnel inside the area secured.

Figure 4:
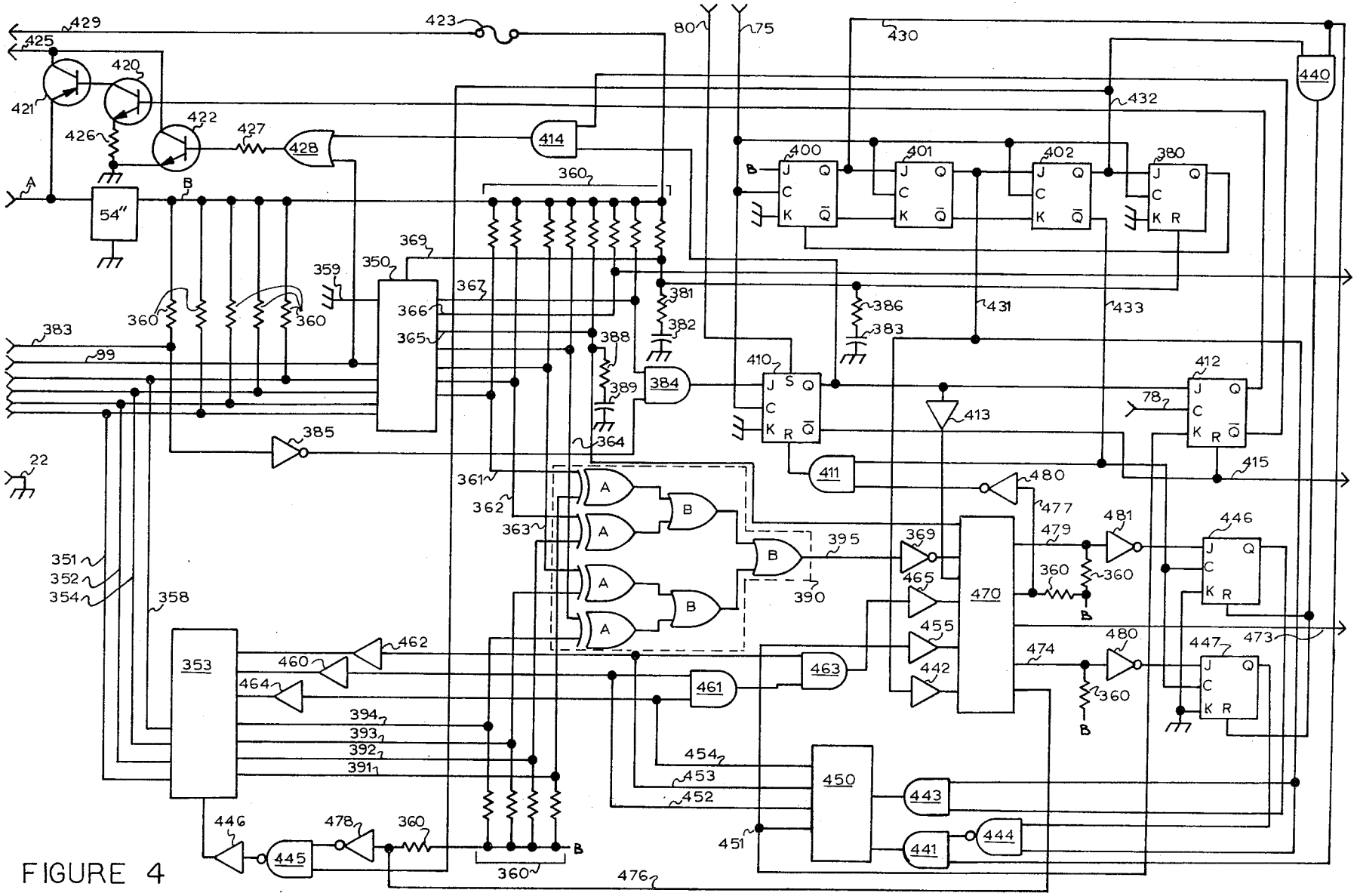
FIG. 4 is a diagram of the combination lock according to the present invention.

Referring now to FIG. 4 there is shown the combination lock, which, for the present invention will be fully described. It should be reemphasized that such a lock could easily be adapted to be utilized in numerous environments other than with a security system and as such, the following should be not considered a limiting citerion. It should again be emphasized that the description of logic devices utilized herein are listed in the table earlier given in the description and that a full and complete description can be obtained from various reference manuals provided therefor.

As shown in FIG. 4 a programmable read only memory PROM 350 is addressed in parallel with the data inputs to a random access memory RAM 353 via lines 351, 352, 354, and 358 which are connected, say, to be operatively addressed from a 12 key keyboard (not shown) such as a low profile keyboard manufactured by the Digitran Company as identified by the manufacturers part number KL0025, which keyboard being adapted to an encoder for adapting the 12 inputs from the keyboard and generating a binary code in hexadecimal hereinafter referred to as Binary Coded Decimal or BCD whose weights are 8, 4, 2, and 1. For a detailed analysis of encoders, Hexadecimal, BCD and weights see "Computer Logic Design" by M. Morris Mano, Prentice-

Hall, Inc., Copyrighted 1972. Status for the lock can be indicated, say, by a Tri State Red/Green light emitting diode (LED) mounted close to the keyboard. The encoder for the preferred embodiment utilizes the numbers 1–9 on such keyboard to represent Hex code 1–9 and number 0 to provide Hex code A. Additional keys C, E, or *, and C-3 (together) represent Hex Code C, D, and F to provide BCD for Clear, Enable or Arm System, and Learn. The fifth address line to PROM 350 is a high true signal which, for example, when utilized with the security system of the present invention would be line 99 (see FIG. 2 or 3) which provides a high true signal when the system is armed. The keyboard inputs on lines 351, 352, 354, and 358 are low true and are at a high level unless activated via having each line connected by 20 k-ohm resistors 360 to the B source provided by another voltage regulator 54" connected to the system A source. Outputs of PROM 350 are lines 361–367 and 369 (the last digit indicates the actual pin numeral for the preferred PROM utilized). Each output line is connected via further 20 k-ohm resistors 360 connected between each output of B source to provide proper operation of the PROM. The final input to PROM 350 is the line 359, grounded to disable further decoding flexibility.

PROM 350 has been programmed in accordance with the manufacturers recommendation to provide the following logic: Line 369, low when four keyboard lines high; line 367, high when four keyboard lines are low and line 99 is low; line 366, low when a low true Hex D is entered from keyboard; line 365, high when lines 354 and 358 are low; and lines 361–364, complement of lines 351, 352, 354, and 358 for Hex codes 1 through A.

PROM 350 output line 369 is also coupled to the reset input of a J-K flip-flop 380 (a portion of a sequencer to be described elsewhere) and ground via series connected 51 ohm resistor 381 and 0.01 microfarad capacitor 382. Output line 367 is coupled to be anded together with another keyboard input signal on line 383 via AND gate 384 whose other input is coupled to line 383 via an inverter 385. Output line 366 is coupled to ground via series connected 51 ohm resistor 386 and 0.01 microfarad capacitor 387 and via a 1 k-ohm resistor (see FIG. 3) forming another input to the debounce network of the flip-flop 114 previously described and has, say, the same effects as the control unit 20F on the operation thereof. Output lines 265 directly connected to one of the address inputs of a second PROM to be described elsewhere and ground via another series connected 51 ohm resistor 388 and 0.01 micorofarad capacitor 389. Output lines 361–364 are directly connected to a comparator 390 for comparing data outputs of RAM 353 on lines 391, 392, and 394 (the last numeral indicating the actual data output as specified by the manufacturer of the preferred device). Each of the lines 391–394 is also coupled to the B source via still further 20k-ohm resistors 360. Comparator 360 is seen to comprise a plurality of exclusive OR gates 390A for exclusively oring together the inputs thereof and a plurality of OR gates 390B for oring together the exclusively ored inputs to provide a single output on line 395 for application via inverter 369 as an address input to the second PROM.

As stated above, a sequencer is provided and consists of a J-K flip-flops 400, 401, 402, and the already mentioned flip-flop 380. Each flip-flop has its clock input coupled to be clocked via the 4 ms clock pulse applied thereto on the line 75. Flip-flop 400 has its J input connected to the B source and its K input grounded. The Q and $\overline{Q}$ outputs of flip-flop 400 are coupled to the J and K inputs of flip-flop 401 respectively whereas the Q and $\overline{Q}$ output thereof are coupled to the J and K input respectively of the flip-flop 402. The Q output of flip-flop 401 is connected to the J input of flip-flop 380, which in turn, has its K input grounded and its Q output coupled to the reset input of flip-flop 400. As can be discussed, the sequencer mearly counts up, clears itself, and repeats the process to provide a plurality of sequence signals for the lock.

Also coupled to be clocked by the 4 ms clock pulses via the line 75 is a mode J-K flip-flop 410 having its J input coupled to the output of AND gate 384 and its K input grounded. This flip-flop is set via the line 80 (from the power up, clear system initiator flip-flop 79 described previously and shown in FIG. 3) and cleared via the AND gate 411. The Q output of mode flip-flop 410 is coupled to the J input of an indicator flip-flop 412, amplified by amplifier 413 as an address signal to the second PROM, and coupled to one input of an AND gate 414 whose other input is coupled to the $\overline{Q}$ output of flip-flop 412. The $\overline{Q}$ output of flip-flop 410 is coupled to the reset input of flip-flop 412 and, by the line 415, to the input of AND gate 124 (FIG. 3) previously mentioned to prevent the system from being armed while the lock is in the Learn mode. (It should also be noted that the line 415 is provided pullup via a 20 k-ohm resistor connected between the B source and line 415 which allows the system to be properly operated without the lock, see FIG. 3.) The Q output of flip-flop 412 is coupled to the base of 2N3904 transistor 420, which, in conjunction with a 2N2905 transistor 421 and a 2N5964 transistor 422 form a control circuit to operate the Tri-State LED's previously mentioned and hereinafter described. Before proceeding, it should be noted that the Tri-State LED indicators are not shown but are to be serially connected between the B source via the fuse 423 inserted into line 424 and line 425 connecting the collectors of both transistors 421 and 422. Transistor 421 has its emitter coupled directly to the A source and its base coupled to the collector of transistor 420. The emitter of transistor 420 is coupled to ground via a 470 ohm resistor 426 whereas the emitter of transistor 422 is grounded. The base of transistor 422 is coupled via a 470 ohm resistor 427 to the output of an OR gate 428. OR gate 428, in turn, OR's together the ouput of AND gate 414 and the signal on the input line 99. In operation, if line 99 is at a high level or if there is coincidence of the Q and $\overline{Q}$ outputs of the mode and indicator flip-flops 410 and 412 respectively, transistor 422 is made conductive thereby effectively grounds the line 425. As such, the indicators are now disposed between the B source and ground to operate same. If however, no coincidence exists between the Q and $\overline{Q}$ outputs transistor 420 is rendered conductive to turn on transistor 421 to effectively place the indicators between the A source and the B source to operate same. Such circuit provides that, since the preferred indicators are red and green indicators, equal light intensities are emitted from the LED's. As stated, flip-flop 412 is clocked from the line 78 at a 512 ms rate so that the indicators can alternate between one another to be described elsewhere.

Referring again to the sequencer it is seen that outputs therefrom are the lines 430, 431, 432, and 433. Line 430 output is coupled to one input of AND gates 440 and 441, line 431 output is coupled via amplifier 422 as an enable input to the second PROM and first inputs of AND gates 443 and NAND gate 444, line 432 output is coupled to the second input of AND gate 440 and the first input of another NAND gate 445, and line 433 output is coupled as one input to the AND gate 411 and as clock inputs to J-K flip-flops 446 and 447 which are cleared by the coincidence of the line 430 and 432 sequencer outputs via AND gate 440. The K inputs to flip-flops 446 and 447 are grounded and have their Q outputs coupled as second inputs to the AND gate 443 and NAND gate 444 respectively. The output of NAND gate 444 is connected at the second input to AND gate 441.

The output of AND gate 441 and 443 are respectively coupled to the clock input and reset input of a 7 stage ripple counter 450 having outputs on lines 451, 452, 453, and 454. The output on the line 451 is applied via the amplifier 455 as an address input to the second PROM and directly to the K input of indicator flip-flop 412. Output line 452 provides the output thereon via an amplifier 460 for an address input to the RAM 353 and as the first input to an AND gate 461. Similarly, output line 453 is coupled via another amplifier 462 as an address input to the RAM 353 and as the first input to an AND gate 463. Finally, output line 454 is coupled via amplifiers 464 as an address input to the RAM 353 and to the second input of AND gate 461 whereby coincidence thereof with the output on output line 452 becomes the second input of AND gate 463. The output of AND gate 463 is amplified by amplifier 465 and applied as another address input to the second PROM.

Second PROM 470 provides an output on line 473 to a 1 k-ohm resistor forming another input to the disable flip-flop 113 previously described and has, say, the same effect as the control unit 20G on the operation thereof. Additionally, outputs therefrom are the lines 474, 476, 477, and 479 (the last numeral corresponding to the active pin numbers as specified by the manufacturer for the preferred device). Output line 474 is provided pullup via 20 k-ohm resistor 360 serially connected to the B source and the output signal thereon is applied via an inverter 480 as the J input to flip-flop 447. Output line 476 is provided pullup via 20 k-ohm resistor 360 serially connected to the B source and the output signal thereon is applied via an inverter 480 as the J input to flip-flop 447. Output line 476 is provided pullup via 20 k-ohm resistor 360 and is coupled via an inverter 478 as the second input to NAND gate 445 the output of which is used to strobe RAM 353 via amplifier 446. Output line 477 is also provided pullup via 20 k-ohm resistor 360 and is coupled to AND gate 411 via an inverter 480. Output line 479 is also provided pullup via a 20 k-ohm resistor and is coupled via an inverter 481 as the J input to the flip-flop 446. PROM 470, like PROM 350 has been programmed to provide outputs on lines 474, 476, 477, and 479 which are at a high level unless activated by inputs. With an enable input via amplifier 442 at a high level, all output lines are high; when the enable is low only certain output lines go low. The outputs are as follows: line 479, low when line 365 (from PROM 350) is high or inputs via amplifiers 369, 413 both low or inputs via amplifier 465 is high and 413 is low, or inputs via amplifier 465, 455, and 413 are high; line 477, low when inputs via amplifiers 455, 465, 369, and 413 are all high; line 476, low when signals via amplifiers 455 and 413 are low and high respectively; line 474, low when signals via amplifiers 465 and 413 both high; and line 473 low when signals via amplifier 413 is low signals via amplifiers 465 and 369 are high.

Having now described the programmed logic for the PROMS 350 and 470 and various other circuits, the operation of the combination lock will be considered. In accordance with the preferred embodiment, the lock provides a means of arming (or enabling) the system in the same manner as other control units for the system as described. Secondly, the lock provides a means of operating the system by successful operation of a 7 digit combination. Thirdly, the lock provides a means, where allowable, to change the combination by simple entering a new combination.

The lock operates in three modes: Operating, Learn, or Verify. Before considering these three modes however, it is necessary to know that a high true input on the line 99 will cause the red indicator to turn on and prevents the lock from being placed in the Learn mode. Additionally, a high input on line 80 will place the system in the Learn mode and will cause the green indicator to turn on. This last mentioned effect occurs when power is initially applied to the system or when a HEX F is entered via the keyboard.

when a HEX F is entered via the keyboard, the lock is set to the Learn mode and the keyboard is utilized to key in a seven digit combination as follows. PROM 350 detects the HEX F and provides on line 367 a high true which allows mode flip-flop 410 to set to its Q high output state. (Power being applied also sets flip-flop 410 to its Q high output state.) Simultaneously, the sequencer flip-flop 380 is cleared via line 369 to sequence the system to a cleared state. The setting of flip-fop 410 allows flip-flop 412 to be set on the next slow clock pulse thereby turning on the green indicator light via transistor 421 pulling line 425 to the A source. Next, a first digit of a 7 digit combination is keyed in via the keyboard and impressed upon the address lines 351, 352, 354, and 358. PROM 350, in turn, causes the sequencer to count and at a proper time counter/divider 450 is advanced 1 count and PROM 470 in conjunction with AND gate 445 will generate a one clock pulse memory write strobe which is applied via amplifier 446 to RAM 353 for latching the digit in the RAM. This process continues for 7 digits. When the counter/divider 450 reaches a count of 7, PROM 470 provides an output to set flip-flop 447 which will advance the count one clock pulse after the keyboard key is released. Advancing the count to 8 asserts a K high on flip-flop 412 allowing flip-flop 412 to toggle at a 512 ms clock rate and alternates both indicators. This signifies that a 7 digit combination has been strobed into the RAM 353 and sets the system into a Verify mode.

The Verify mode and operation thereof is exactly as the Learn mode except it is intended to verify the combination entered in the Learn mode i.e., the 7 digit combination must be keyed in again. If successful operation of the entire 7 digit combination is performed, PROM 470 provideds an output via gate 411 to clear flip-flop 410. If a mismatch occurs in any digit, PROM 470 output via line 479 and flip-flop 446 clears counter 450 and the lock is placed back into the Learn mode where by a new combination must be entered.

The successful varification of a 7 digit combination being entered causes the lock to be placed in the Operating mode. In this mode, the keyboard status indicator lights will be extinguished and the entire system can be armed against intrusion from the keyboard or from the pick proof lock already discussed and disarmed by successful entering the 7 digit combination. Clearly, a unique feature of the lock is the simplicity of the seven digit implementation, an object of the present invention.

Figure 5:
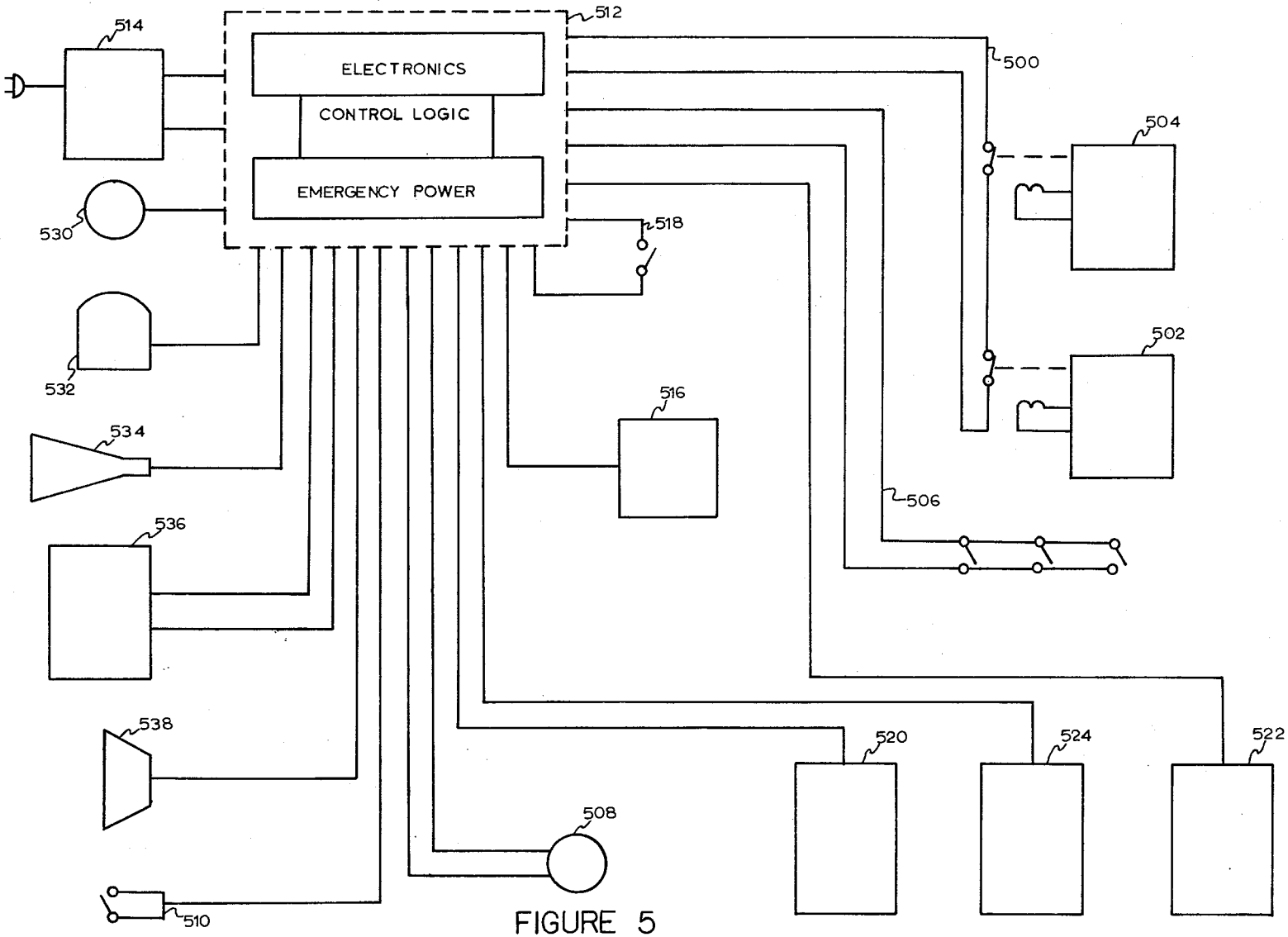
FIG. 5 is a block diagram of a typical system in accordance with the present invention.

Referring now to FIG. 5, there is shown a block diagram from a typical total security system for a security area utilizing the present invention. Detection means for detecting a security within the security area are provided by (1) closed loop circuits 500 responsive to, say, conventional infared beam means 502 or bridge impedance means 504, (2) open loop circuit 506 such as mat switches, tape switches, vibration switches, proximity detectors, etc., (3) ionization type smoke detectors 508 and (4) tamper protection switch means 510. Responsive to the detection of a security violation within the security arm is the means 512. Means 512 includes the system control logic, electronics, and emergency power as fully described for the embodiment of FIG. 2, 3, and 4. Means 512 is provided main power from an AC source via a DC power supply 514. Means 512 is also responsive to be controlled by say, the combination lock 516 as fully described for the embodiment of FIG. 4, a panic button means 518, a plurality of single function disable means 520, a plurality of single function enable means 522 and a plurality of dual function enable/disable means 524. (Means 520, 522, and 524 could include any number of enable or disable or both enable/disable means connected in parallel.)

Means 512, in turn, provides therefrom a plurality of signals for activating a plurality of indicator means such as, for example, a pre-alarm warning device 530, a beacon light 532, sirens and/or speakers 534, telephone dialer 536 and further sirens and/or speakers 538. As the operation of the system has been already discussed, no further discussion is believed necessary.

Obviously, many modifications and variations of the present invention are possible in light of the above teachings. For example, the system may be adapted to be operable in conjunction with any brand of sensors. The system may be used in conjunction with any visual display device. It is therefore to be understood that within the scope of the appended claims the invention may be practical otherwise than as specifically described.

The invention is claimed in accordance with the following:

1. A system for the automatic detection of the presence of intrusion or fire within a security area, comprising:

means for sensing a fire alarm condition and including means for generating a first distinguishable signal in response to said fire alarm condition;

means for sensing an intrusion alarm condition and including means for generating a second distinguishable signal in response to said intrusion alarm condition, said means for generating including:

verification means operatively coupled to said means for sensing an intrusion alarm condition for verifying the intrusion;

first alarm means responsive to the verification of the intrusion for providing a pre-alarm signal;

second alarm means operably associated with said first alarm means for providing said second distinguishable signal, said second alarm means including means for selectively delaying the generation of said second distinguishable signal a selected period of time after said pre-alarm signal; and means responsive to said first and said second distinguishable signals for automatically signaling the presense of fire or intrusion.

2. The system according to claim 1, further comprising:

primary power source means for providing a potential source to energize the system;

secondary power source means for providing a standby potential source to energize the system, said secondary power source energizing the system only when the potential of the primary source means is below the potential of said secondary power source means; and logic means disposed between both said source means for sensing the potentials thereof and coupling the highest potential to energize the system.

3. The system according to claim 2, further comprising:

means coupled to said primary source means for signaling a warning to indicate when said primary source means is below a minimum potential to energize the system; and means coupled to said secondary means for signaling a warning to indicate when said secondary source means is below a minimum potential to energize the system.

4. The system according to claim 1 further comprising control means operable associated with both said means for sensing a fire alarm condition and said means for sensing an intrusion alarm condition for controlling the system.

5. The system according to claim 4 wherein said control means defines a key operated lock switch means.

6. The system according to claim 4 wherein said control means defines a keyboard operated electronically programmed combination lock means.

7. The system according to claim 1 wherein said means for sensing an intrusion alarm condition further comprises means to detect the tampering of said means for sensing an intrusion alarm condition coupled directly to said first and said second alarm means for cuasing said second distinguishable signal to be generated immediately.

8. The system according to claim 1 wherein said means for sensing an intrusion alarm condition further comprises a panic means coupled directly to said first and said second alarm means for causing said second distinguishable signal to be generated immediately.

9. The system according to claim 8 wherein said panic means includes activated circuit means requiring a plurality of sequential activations before activating said first and second alarm means for providing said second distinguishable signal.

10. The system according to claim 1 wherein said means responsive to said first and second distinguishable signals, further comprises:

a tone generator;

means for gating said tone generator in accordance with said first and second distinguishable signals to provide a first tone signal and a second tone signal; and means responsive to said first and second tone signals to distinguishably signal the violation within the security area.

11. The system in accordance with claim 10 wherein said means responsive to said first and second tone signals further comprises:

amplifier means for amplifying said first and second tone signals; and audio speaker means responsive to the amplified first and second tone signals for providing audio indications thereof to signal the violation within the security area.

12. The system in accordance with claim 11 wherein said amplifier means is inhibited except when said first or said second distinguishable signals are present.

13. The system according to claim 1 wherein said means responsive to said first and second distinguishable signals further includes means for signaling the violation within the security area to appropriate responding agencies.

14. The system according to claim 13 wherein said means for signaling the violation within the security area to appropriate responding agencies defines a telephone dialing apparatus for dialing law enforcement agencies or fire prevention agencies.

* * * * *